US010687164B2

(12) United States Patent
Baque et al.

(10) Patent No.: US 10,687,164 B2
(45) Date of Patent: Jun. 16, 2020

(54) PROCESSING IN SUB-BANDS OF AN ACTUAL AMBISONIC CONTENT FOR IMPROVED DECODING

(71) Applicant: ORANGE, Paris (FR)

(72) Inventors: Mathieu Baque, Chatillon (FR); Alexandre Guerin, Chatillon (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 16/471,371

(22) PCT Filed: Dec. 15, 2017

(86) PCT No.: PCT/FR2017/053622
§ 371 (c)(1),
(2) Date: Jun. 19, 2019

(87) PCT Pub. No.: WO2018/115666
PCT Pub. Date: Jun. 28, 2018

(65) Prior Publication Data

US 2019/0335291 A1 Oct. 31, 2019

(30) Foreign Application Priority Data

Dec. 21, 2016 (FR) ..... 16 63079

(51) Int. Cl.
*H04S 7/00* (2006.01)
*G10L 21/0232* (2013.01)
(Continued)

(52) U.S. Cl.
CPC ..... *H04S 7/307* (2013.01); *G10L 21/0232* (2013.01); *H04R 3/04* (2013.01);
(Continued)

(58) Field of Classification Search
CPC ..... G10L 19/008; G10L 21/0232; G10L 21/0272; G10L 2021/02163; H04S 7/307;
(Continued)

(56) References Cited

U.S. PATENT DOCUMENTS

2011/0249822 A1* 10/2011 Jaillet ..... G10L 19/008 381/22
2012/0155653 A1* 6/2012 Jax ..... G10L 19/008 381/22
(Continued)

FOREIGN PATENT DOCUMENTS

WO 2010076460 A1 7/2010

OTHER PUBLICATIONS

English translation of the Written Opinion of the International Searching Authority dated Jun. 25, 2019 for corresponding International Application No. PCT/FR2017/053622, filed Dec. 15, 2017.
(Continued)

*Primary Examiner* — Yogeshkumar Patel
(74) *Attorney, Agent, or Firm* — David W. Brush; Westman, Champlin & Koehler, P.A.

(57) ABSTRACT

A method implemented by a processing device for processing an ambisonic content including a plurality of ambisonic components of a plurality of orders defining a succession of ambisonic channels in each of which an ambisonic component is represented. The method includes: frequency filtering of the ambisonic components in a plurality of frequency bands, compiling an ambisonic decoding matrix, processing the ambisonic decoding matrix in order to extract, by matrix dimension reduction, a plurality of ambisonic decoding
(Continued)

sub-matrices each associated with an ambisonic order and a frequency band selected for this ambisonic order, respective applications of the decoding sub-matrices to the ambisonic components in each selected frequency band, and a reconstruction, band by band, of the results of said respective applications, in order to deliver a plurality of decoded signals, each associated with a sound source.

15 Claims, 7 Drawing Sheets

(51) Int. Cl.
*H04R 3/04* (2006.01)
*H04R 5/04* (2006.01)
*G10L 21/0216* (2013.01)

(52) U.S. Cl.
CPC ..... *H04R 5/04* (2013.01); *G10L 2021/02163* (2013.01); *H04S 2420/11* (2013.01)

(58) Field of Classification Search
CPC ..... H04S 3/02; H04S 3/008; H04S 2420/11; H04R 3/04; H04R 5/04
See application file for complete search history.

(56) References Cited

U.S. PATENT DOCUMENTS

2014/0307894 A1* 10/2014 Kordon ..... H04R 3/005 381/92
2015/0194161 A1* 7/2015 Najaf-Zadeh ..... G10L 19/0212 704/500
2017/0243589 A1* 8/2017 Krueger ..... G10L 19/008
2019/0349699 A1* 11/2019 Keiler ..... H04S 3/02

OTHER PUBLICATIONS

International Search Report dated Jun. 25, 2019 for corresponding International Application No. PCT/FR2017/053622, filed Dec. 15, 2017.
M. Baque, A. Guerin, M.Melon: "Separation de sources appliquee a un contenu ambisonique: localisation et extraction des champs directs". Congres Francais d'Acoustique et le 20e colloque Vibrations, SHocks and NOise, CFA/VISHNO 2016, Apr. 1, 2016 (Apr. 1, 2016), pp. 1-6, XP055361095.
Graczyk J Skoglund Google Inc M: "Ambisonics in an Ogg Opus Container; Draft-ieff-codec-ambisonics-01.txt",Internet Engineering Task Force, IETF; Standardworkingdraft. Internet Society (ISOC) 4, Rue Des Falaises Ch—1205 Geneva, Switzerland, Nov. 22, 2016 (Nov. 22, 2016), pp. 1-10. XP015116784.

* cited by examiner

PROCESSING IN SUB-BANDS OF AN ACTUAL AMBISONIC CONTENT FOR IMPROVED DECODING

CROSS-REFERENCE TO RELATED APPLICATIONS

This application is a Section 371 National Stage Application of International Application No. PCT/FR2017/053622, filed Dec. 15, 2017, the content of which is incorporated herein by reference in its entirety, and published as WO 2018/115666 on Jun. 28, 2018, not in English.

FIELD OF THE DISCLOSURE

This invention relates to the field of audio or acoustic signal processing, and more particularly to the processing of actual multichannel sound content in ambiophonic format (or "ambisonic" hereinafter).

BACKGROUND OF THE DISCLOSURE

The ambisonic technique consists in using in each frequency band a sub-set of channels that have sought directivity characteristics. By way of example of application, mention can be made of:

Sound source separation:
- For entertainment (karaoke: voice suppression),
- For music (mixing separated sources in a multichannel content),
- For telecommunications (voice boosting, noise suppression),
- For home automation (voice control),
- Multichannel audio encoding.

Decoding for multichannel diffusion:
- For the cinema,
- For music,
- For virtual reality.

Ambisonics consists in protecting an acoustic field over a base of spherical harmonic functions (base shown in FIG. 1), in order to obtain a spatialised representation of the sound stage. The function $Y_{mn}^{\sigma}(\theta, \phi)$ is the spherical harmonic of order m and of index nσ, depending on spherical coordinates (θ, ϕ), defined with the following formula:

$$Y_{mn}^{\sigma}(\theta, \phi) = \tilde{P}_{mn}(\cos\phi) \cdot \begin{cases} \cos n\theta & \text{if } \sigma = 1 \\ \sin n\theta & \text{if } \sigma = -1 \text{ and } n \geq 1 \end{cases}$$

where $\tilde{P}_{mn}(\cos\phi)$ is a polar function involving the Legendre polynomial:

$$\tilde{P}_{mn}(x) = \sqrt{\epsilon_n \frac{(m-n)!}{(m+n)!}} (-1)^n (1-\cos^2 x)^{\frac{n}{2}} \frac{d^n}{dx^n} P_m(x) \text{ with } \epsilon_0 = 1 \text{ and } \epsilon_0 = 2 \text{ for } n \geq 1 \text{ and}$$

$$P_m(x) = \frac{1}{2^m \cdot m!} \frac{d^n}{dx^n} (x^2-1)^m$$

As shown in FIG. 1, the first "vector" of the spherical harmonic base (at the top in FIG. 1) corresponds to the order m=0, the three "vectors" in the following line correspond to the order m=1 (oriented according to the three directions of space), etc.

In practice, an actual ambisonic encoding is carried out using a network of sensors, generally distributed over a sphere, which are combined in order to synthesise an ambisonic content of which the channels best respect the directivities of the spherical harmonics (as shown in FIG. 2). In reference to FIG. 2, a microphone MIC comprises a plurality of piezoelectric capsules C1, C2, . . . which receive sound waves according to various directions of arrival of space. A processing unit UT that receives the signals coming from these capsules carried out an ambisonic encoding using a matrix of filters presented hereinafter, and delivers ambisonic signals (formalised in a base of spherical harmonics of the type shown in FIG. 1).

The basic principles of ambisonic encoding are described hereinafter.

The ambisonic formalism, initially limited to the representation of spherical harmonic functions of order 1, was subsequently extended to the higher orders. The ambisonic formalism with a higher number of components is commonly referred to as "Higher Order Ambisonics" (or "HOA" hereinafter).

To each order m corresponds 2m+1 spherical harmonic functions, as shown in FIG. 1. Thus, a content of order M contains a total of $(M+1)^2$ channels (4 channels with order 1, 9 channels with order 2, 16 channels with order 3, and so on).

The term "ambisonic components" hereinafter means the ambisonic signal in each ambisonic channel, in reference to the "vector components" in a vector base that would be formed by each spherical harmonic function. Thus for example, it is possible to count:

one ambisonic component for the order m=0,
three ambisonic components for the order m=1,
five ambisonic components for the order m=2,
seven ambisonic components for the order m=3, etc.

The ambisonic signals captured for these various components are then distributed over a number N of channels which is deduced from the maximum order m that it is provided to capture in the sound stage. For example, if a sound stage is captured with an ambisonic microphone with 20 piezoelectric capsules, then the maximum captured ambisonic order is M=3, so that there is not more than 20 channels $N=(M+1)^2$, the number of ambisonic components considered is 7+5+3+1=16 and the number N of channels is N=16, given moreover by the relationship $N=(M+1)^2$, with M=3.

The ambisonic capture x(t) of order M and comprised of N sound sources $s_i$ of incidence $(\theta_i, \phi_i)$ propagating in a free field can then be written mathematically in the following matrix form:

$$x(t) = As(t) = \begin{bmatrix} 1 & \dots & 1 \\ \vdots & \ddots & \vdots \\ Y_{Mn}^{\sigma}(\theta_1, \phi_1) & \dots & Y_{Mn}^{\sigma}(\theta_N, \phi_N) \end{bmatrix} s(t)$$

Where A is a matrix referred to as "mixing matrix", of dimensions $(M+1)^2 \times N$ and of which each column $A_i$ contains the mixing coefficients of the source i.

Physically, this matrix A corresponds to the encoding coefficients of each source i, associated with each direction of each source i. In order to extract the sources from such a content, a matrix B referred to as "separating matrix", inverse of the matrix A, must be estimated. In order to obtain the matrix B, a step of blind source separation can be implemented, for example by using an independent component analysis (or "ICA" hereinafter) algorithm, or a main component analysis algorithm. The matrix $B=A^{-1}$ allows for the extraction of the sources via the following operation:

$$s(t)=Bx(t)$$

This step amounts to forming beams (or "beamforming" hereinafter), i.e. in combining various channels that have separate directivities, in order to create a new component that has the desired directivity. An example of beamforming in order to extract three components, for a HOA content of order 2, 4 or 6, is shown in FIG. 3. The higher the order is, the more directive the beamforming is and the higher the number of components that can be extracted is.

In practice, generating ambisonic signals $x(t)=As(t)$ passes through an intermediate step of microphone capture such as shown in FIG. 2, where the sources s(t) are captured by the capsules of the microphone MIC in order to form the signals p1, p2, p3 . . . . The microphone encoding matrix E is then formalised such that $x(t)=E\cdot p(t)$, in order to obtain the ambisonic components x1, x2, . . . , xN (in N ambisonic channels as shown in FIG. 4). In reference now to FIG. 4, the inverse decoding matrix B of the matrix A, as presented hereinabove, is estimated, in order to determine the source signals s1, s2, s3:

$$s(t)=Bx(t)$$

To decode an HOA content on a system of speakers, the approach is similar. Ambisonic signals in N channels x1, x2, . . . , xN are acquired, but, here, instead of considering s(t) as the sum of the contributions of sources, s(t) is considered as the sum of the signals emitted by a set of speakers (which then effectively makes it possible to supply these speakers with the signals s1, s2, s3 . . . ). The decoding matrix B is therefore formulated here using the positions of the speakers of a sound restitution system and the signals intended for the speakers according to the same method as the one used for the source separation are extracted.

In reality, the sensors used have physical limitations that cause a degradation in the microphone encoding, and therefore a degradation in the directivity of the ambisonic components. For example, the encoding of the high frequencies is degraded when the inter-sensor spacing becomes approximately greater than one half-wavelength: this is due to the phenomenon of spatial aliasing. At low frequencies, the microphone capsules tend to become omnidirectional and it becomes impossible to obtain the sought directivities. More precisely, the degradations at low frequencies are more marked when it entails synthesising ambisonic components of a high order. Generally, associated directivities are more complex and therefore more sensitive to variations in the properties of the sensors. FIG. 5 shows the degree of correlation between a theoretical encoding and an actual encoding using a spherical microphone with 32 capsules, according to the frequency and the ambisonic order. FIG. 5 shows that the highest degree of correlation is generally reached for frequencies between 1 kHz and 10 kHz. However, for the other frequency ranges (except for ambisonic orders 0 and 1), extracting sources would not always lead to the same result for a theoretical encoding and for an actual encoding of these same sources. More precisely, for frequencies outside of the interval [1 kHz-10 kHz], the components extracted are potentially degraded.

FIG. 6 shows the actual directivity in the horizontal plane of the first components of orders 0, 1, 2 and 3 according to the sound frequency. It appears, in FIG. 6, that the actual components are not suitably encoded. Indeed, if the example is considered of the component of order 0 at the frequency of 10 kHz, it is observed that it is not circular, contrary to the theoretical component and to the same component calculated at the frequencies between 300 and 1000 Hz. Thus, the directivity of this component at the frequency of 10 kHz is not respected, which could induce a degraded spatial resolution. Moreover, the components at order 1, 2 and 3 also have biased directivities for frequencies that are lower than 10 kHz.

More generally, when the theoretical directivity is not respected, the beamforming carried out no longer makes it possible to suitable extract the sought components. For example, this results in the appearance of interferences during source separation. This can also result in a degradation of the spatial resolution in frequency bands concerned by a multichannel diffusion. More particularly, a loss of energy in the low frequencies in the high orders during encoding is observed. This induces that the sources extracted thanks to channels of high orders can lose part of their energy in the frequencies concerned.

The utilisation of beamforming for source separation or for the restitution of an ideal ambisonic content or of a multichannel capture is already used in particular for the separating, or for multichannel decoding. For source separation, an inversion of the mixing matrix estimated via independent component analysis is used in order to extract the sources. For the multichannel decoding, the matrix of the ambisonic coefficients relating to the speakers can be inverted. On the other hand, the processing of an actual ambisonic content, affected by the physical limitations of the recording system, is not addressed in prior art. The only solution currently proposed is to limit the total bandwidth of the extracted sources, which is not satisfactory.

SUMMARY

This invention improves this situation.

It proposes for this purpose a method, implemented by computer means, for processing an ambisonic content comprising a plurality of ambisonic components of a plurality of orders defining a succession of ambisonic channels in each of which an ambisonic component is represented, the method comprising:

- frequency filtering of the ambisonic components in a plurality of frequency bands,
- compiling an ambisonic decoding matrix,
- processing the ambisonic decoding matrix in order to extract, by matrix dimension reduction, a plurality of ambisonic decoding sub-matrices each associated with an ambisonic order and a frequency band selected for this ambisonic order,
- respective applications of the decoding sub-matrices to the ambisonic components in each selected frequency band, and a reconstruction, band by band, of the results of said respective applications, in order to deliver a plurality of decoded signals, each associated with a sound source.

The term "sound source" here means:

- a sound source effectively identified and located in the three-dimensional space (in source extraction technique), in which case the decoding matrix is a source separating matrix, or
- a speaker among several speakers, with a position that is well identified in the space, and supplied in particular with one of the aforementioned decoded signals.

A frequency band can be defined by several frequency bands or frequency sub-bands.

The developing of ambisonic decoding sub-matrices for each frequency band, and for each ambisonic order, makes it possible to benefit in each frequency band from a maximum number of ambisonic channels which are actually valid in each sub-matrix, in order to restore a decoded signal that is not or is hardly degraded.

According to an embodiment, each ambisonic decoding sub-matrix is associated with a frequency band selected according to a validity criterion of the ambisonic components of the order with which said sub-matrix is associated, in said selected frequency band.

Such an embodiment makes it possible to isolate the ambisonic components that form each order, so as to process them in the range of frequencies wherein they are valid. The term "valid" means respect with the theoretical ambisonic representation, such as for example the order m=4 in the frequency band 4000 to 6000 Hz in the example of FIG. 5, or the order m=3 in the frequency band 2000 to 9000 Hz.

Thus, in an embodiment, the validity criterion of the components can be defined by conditions for capturing said ambisonic components, by at least one ambisonic microphone.

In this embodiment for example, the method can further comprise:

- receiving data from at least one ambisonic microphone used to capture said ambisonic components;
- determining of frequency bands selected for constructing said sub-matrices, according to said ambisonic microphone data.

Knowledge of the data of the ambisonic microphone used for the ambisonic capture makes it possible to refine the determining of the frequency bands selected for the development of the sub-matrices. Indeed, the ambisonic processing is done on sub-matrices of which the ambisonic components strictly meet the validity criterion in the associated frequency bands.

However, the data of the ambisonic microphone used for the capturing are not always accessible. Alternatively, it is therefore possible to provide for the determining of the frequency bands using a chart established beforehand using measurements taken over a plurality of ambisonic microphones, so as to establish "average" frequency ranges, associated with an ambisonic order, wherein the ambisonic components of each ambisonic order generally meet the aforementioned validity criterion.

Thus, according to an embodiment, each ambisonic decoding sub-matrix being associated with an ambisonic order and a frequency band selected for this ambisonic order,

- a frequency band can be selected in the range from 100 Hz to 10 kHz for the ambisonic order m=1,
- a frequency band can be selected in the range from 500 Hz to 10 kHz for the ambisonic order m=2,
- a frequency band can be selected in the range from 2000 Hz to 9000 Hz for the ambisonic order m=3,
- a frequency band can be selected in the range from 3000 Hz to 7000 Hz for the ambisonic order m=4.

In an embodiment where the frequency bands are obtained by fast Fourier transform (FFT), a frequency band associated with an ambisonic order can comprise several frequency bands FFT. Thus, several frequency bands can be associated with an ambisonic order.

In an example of this embodiment where an FFT is used, for a signal sampled at 48 kHz and for an FFT size of 4096 points ($2^{12}$), the bands no. 10 to 910 correspond to the frequency band 100 to 10 kHz and are associated with ambisonic order m=1.

Thus, it is possible to define a validity criterion based on average values of the frequency bands for each ambisonic order, even if the data of the ambisonic microphone used for the capturing of ambisonic components is not accessible.

According to a particular embodiment, the processing of the ambisonic decoding matrix comprises:

- inverting the developed ambisonic decoding matrix, in order to obtain a mixing matrix of which:
- the lines correspond to respective ambisonic channels, and
- the columns correspond to sound sources,
- processing the mixing matrix in order to extract, by matrix dimension reduction, a plurality of mixing sub-matrices each associated with an ambisonic order and a selected frequency band, and
- inverting mixing sub-matrices in order to obtain respectively said ambisonic decoding sub-matrices.

It is thus understood that a frequency filtering of the components of order m=4 between 4000 to 6000 Hz, in the example of FIG. 5, makes it possible to construct a sub-matrix, in particular a mixing sub-matrix (matrix noted as A hereinabove), with $N=(m+1)^2=25$ lines, by retaining the first 25 ambisonic channels. However, for this purpose, it is preferable that the ambisonic signal be represented sufficiently in this frequency band 4-6 kHz, as shall be seen hereinafter. Moreover, if the ambisonic signal is well represented also in the low frequencies, for example between 100 and 200 Hz, a sub-matrix for the order m=1 can furthermore be constructed for example, with N=4 lines. It is thus possible finally to obtain a plurality of mixing sub-matrices, each associated with an ambisonic order m, and each comprising a number of lines that corresponds to a number of valid ambisonic channels for this order m and in the frequency band to which this sub-matrix is associated.

In an embodiment, the processing of the ambisonic content is conducted for a source separation and said decoding matrix is a blind source separation matrix developed from ambisonic components.

For example, the separating matrix can be developed using ambisonic components filtered at a selected frequency band and preferably wherein the number of valid ambisonic channels according to the aforementioned criterion is maximal.

Thus, the channels are retained for a representation accuracy at such an ambisonic order that is the highest, but also in order to retain a maximum of correctly represented channels in this frequency band, at lower ambisonic orders.

In this embodiment, it is possible to simplify the mixing sub-matrices before the inversion thereof, via a reduction in the number of column of each sub-matrix, with the remaining columns of the sub-matrices being selected in such a way as to retain signals with the highest energies after application of the decoding sub-matrices.

Indeed, retaining the signals with the highest energy makes it possible to better represent, and therefore better restore, the sound field.

As a complement or as an alternative, it is possible to select to favour extracted signals that are the most decorrelated, or the most independent according to a selected independence criterion.

Thus, in this embodiment, mixing sub-matrices are simplified before the inversion thereof, via a reduction in the number of columns of each sub-matrix, with the remaining columns of the sub-matrices being selected in such a way as to retain the least correlated signals after application of the decoding sub-matrices.

Moreover, in a reverberating environment, the signal is formed of direct fields coming from the "free field" equivalent propagation of each source and from reflections on the walls of the acoustic environment. Thus, in an alternative or complementary embodiment, mixing sub-matrices are simplified before the inversion thereof, via a reduction in the number of column of each sub-matrix, with the remaining columns of the sub-matrices being selected in such a way as to retain the signals corresponding to direct sound fields after application of the decoding sub-matrices.

Of course, in an embodiment where the processing of the ambisonic content is conducted for an ambisonic restitution on a plurality of speakers, the aforementioned decoding matrix can be an inverse matrix of relative spatial positions of the speakers.

In an embodiment shown hereinafter in reference to FIG. 9, the method comprises in particular, for an ambisonic content broken down into frequency sub-bands, an application of decoding sub-matrices, obtained by:

For each ambisonic order of the content, a determining of a frequency band on which said order respects a predetermined validity criterion of ambisonic encoding, Based on said frequency bands, an application of a filter bank to the ambisonic content in order to produce a plurality of signals in sub-bands, of variable dimensions corresponding to valid ambisonic channels in this sub-band, A determining of a decoding matrix of maximum size in the frequency band of the maximum ambisonic order and of an associated mixing matrix, inverse or pseudo-inverse of said decoding matrix, For each other frequency band, a determining of a mixing matrix of reduced size, sub-matrix of said mixing matrix, and of a separating sub-matrix, inverse or pseudo-inverse of said mixing sub-matrix, A reconstructing of full-band separated signals by application of a synthetic filter bank to the separated signals coming from the multiplication of said signals by said matrices.

This invention also relates to a computer program comprising instructions for implementing the method when this program is executed by a processor. An example logical diagram of the general algorithm of such a program is shown in FIG. 7 commented on hereinafter, which is specified in FIGS. 8 and 9.

This invention also relates to a computer device comprising:

an input interface for receiving ambisonic component signals, an output interface for delivering decoded signals, each associated with a sound source, and a computer program for implementing the method.

An example of such a device is shown in FIG. 10 commented on hereinafter.

This invention thus proposes to use the formation of beams using an actual ambisonic encoding by taking advantage, in each frequency band, of all of the channels of which the directivity respects the ambisonic formalism. An embodiment presented hereinabove then makes it possible to determine one or several mixing matrices Ak, corresponding to sub-matrices obtained from the theoretical matrix A, and each formulated in a frequency band, then inverted in order to give the decoding matrices Bk.

Thus, the invention offers a generic processing of any ambisonic content, and in particular actual, possibly affected by the physical limitations of a recording system, and this without any constraint aimed at limiting the total bandwidth of the extracted sources.

BRIEF DESCRIPTION OF THE DRAWINGS

Other advantages and characteristics of the invention shall appear when reading the detailed description hereinafter of embodiments of the invention, and when examining the accompanying drawings wherein.

DETAILED DESCRIPTION OF ILLUSTRATIVE EMBODIMENTS

Figure 7:
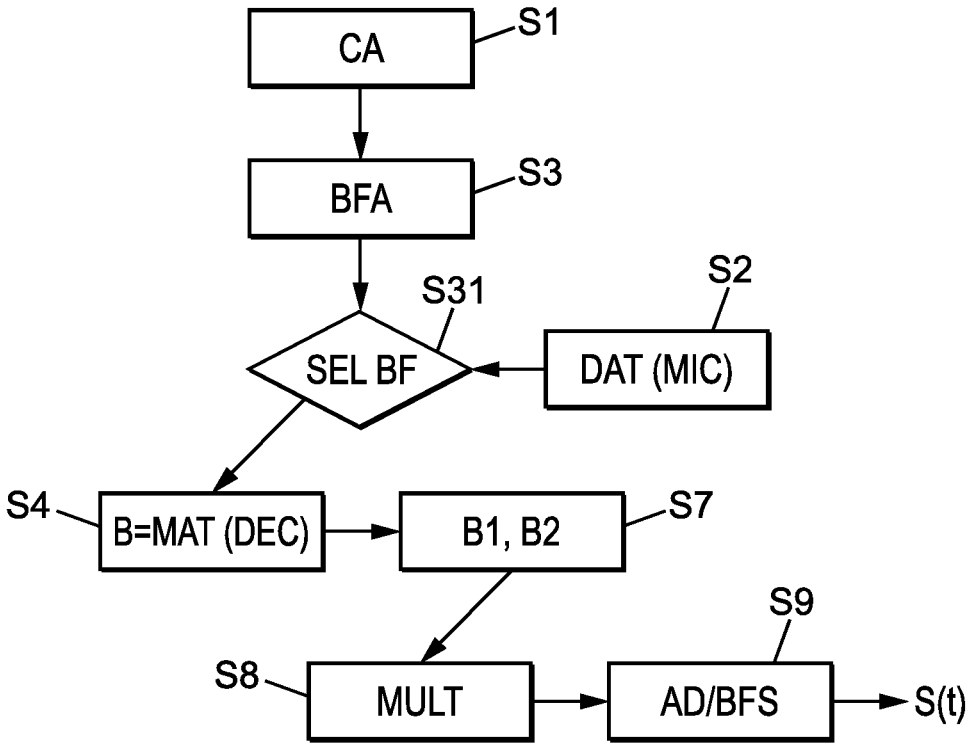
FIG. 7 shows the main steps of an example of the method in terms of the invention.

The general diagram of a global method of ambisonic processing in terms of the invention is shown in FIG. 7. This is for example an ambisonic decoding method. The terms "ambisonic decoding" mean the supply of decoded signals for example intended to supply respective speakers for an ambiophonic restoration, as well as a supply, more generally, of signals each associated with a sound source, in particular in the source separation technique.

Figure 1:
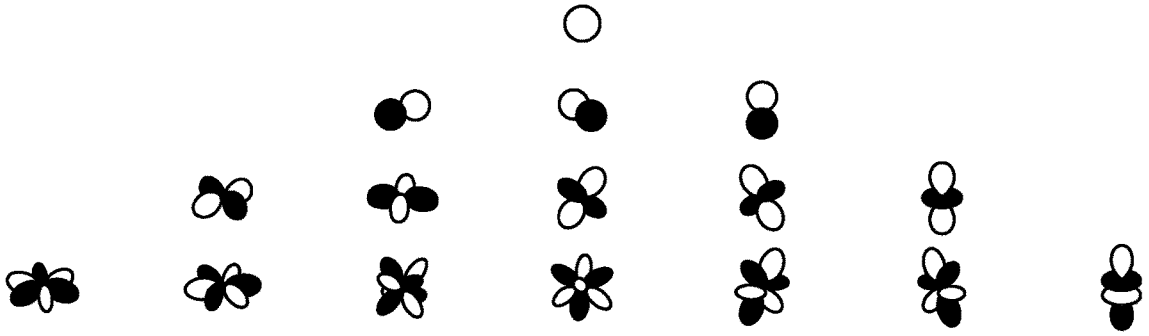
FIG. 1 shows a base of spherical harmonic functions of order 0 (first line) to 3 (last line), with the positive values in light grey, and dark grey for the negative values.
Figure 2:
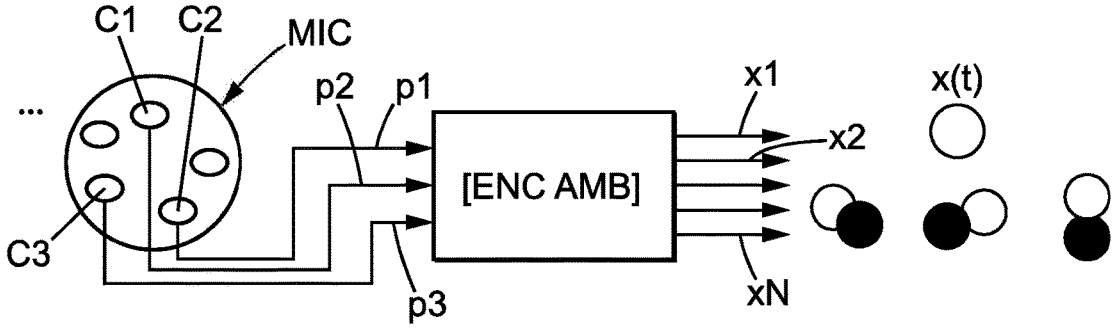
FIG. 2 shows an ambisonic encoding system using a spherical microphone.
Figure 3:
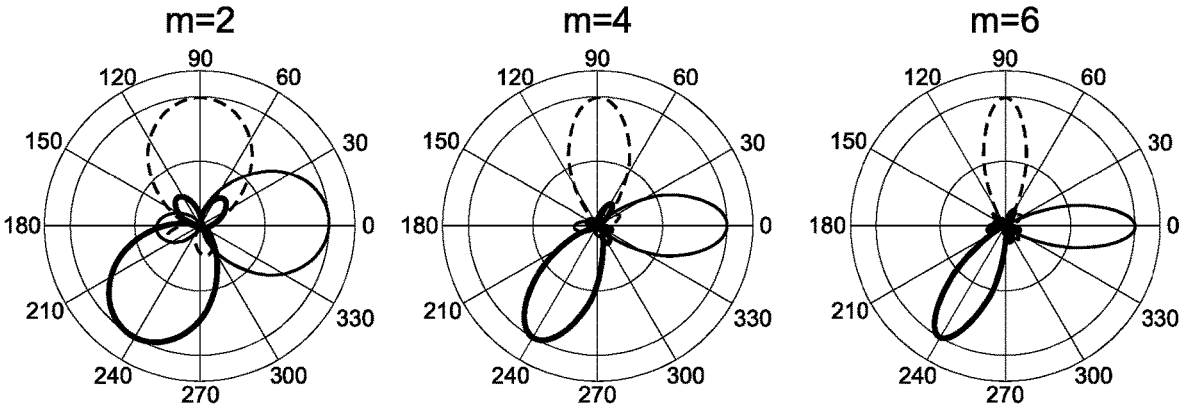
FIG. 3 shows the forming of beams for the extracting of three components, for different ambisonic orders, FIG. 4 very diagrammatically shows an ambisonic decoding system using ambisonic components.
Figure 4:
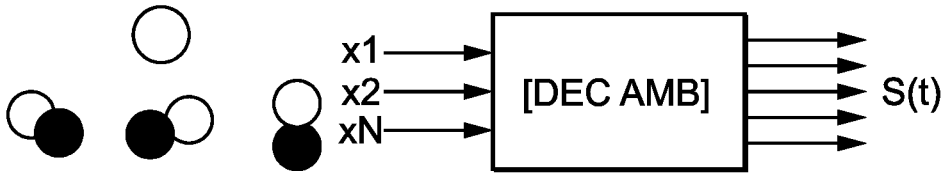
Figure 5:
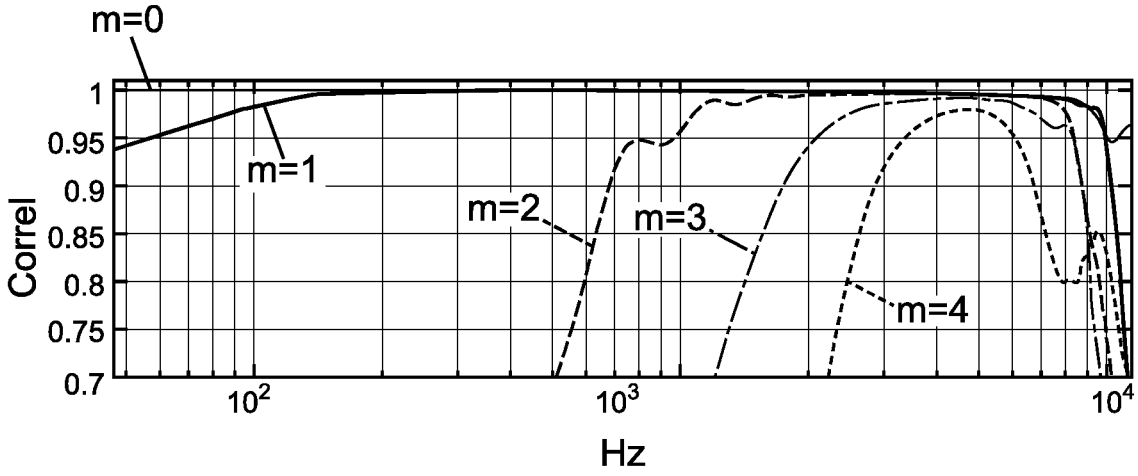
FIG. 5 shows the correlation between an ideal ambisonic encoding and an actual encoding.
Figure 6:
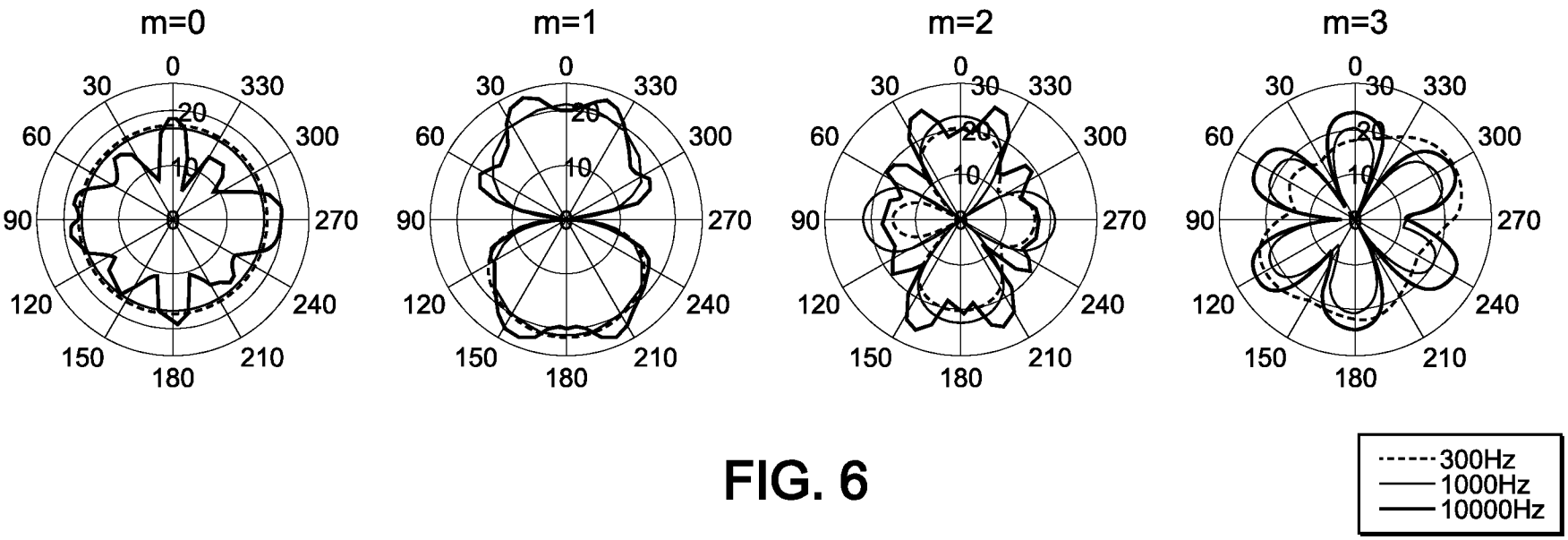
FIG. 6 shows the directivity in the horizontal plane, measured for an actual ambisonic encoding (with from left to right successively the components of the orders 0, 1, 2 and 3)

In the step S1, there is an ambisonic content x(t) comprising a plurality of ambisonic components CA, of successive orders m=0, 1, . . . , M (with for example M=4) and, coming from a recording, or from a "capture", by at least one ambisonic microphone MIC. An ambisonic microphone is a microphone comprised of a plurality of microphone capsules generally distributed spherically and as evenly as possible. These capsules play the role of sound signal sensors. The microphone capsules are arranged on the ambisonic microphone in such a way as to capture the sound signals according to their directivity in space. As shown in FIG. 5, all of the capsules that form such an ambisonic microphone can acquire different ambisonic components at ambisonic orders up to M, but the accuracy of the ambisonic representation for these various orders is not really respected for all of the frequencies of the audio spectrum between 0 and 20 kHz. However, the invention here proposes to isolate certain frequencies of the spectrum for which the ambisonic components, for given orders, are correct (such as for example in the range of frequencies between 4000 and 6000 Hz for the order m=4 in FIG. 5, or more largely the range between 2000 Hz and 9000 Hz for the order m=3, etc.).

However, frequency variations in the accuracy of the ambisonic representation of each order of FIG. 5 are obtained for a particular microphone that has dimensions and a given number of capsules. Thus, for another microphone, other spectral variations can be expected.

The step S2 therefore aims to recover the data that characterises the ambisonic microphone MIC (and possible the conditions for capturing the ambisonic content c(t), and/or the reverberation conditions during the capturing, or others).

More generally, a characterising piece of data of the ambisonic microphone MIC can be the inter-capsule spacing. Indeed, the encoding of high frequencies is degraded when the inter-capsule spacing becomes greater than one half-wavelength. This is due to the phenomenon of spatial aliasing. Inversely, for a low frequency signal, microphone capsules that are too close cannot generate the designed directivity.

In the step S3, it is possible to apply an analysis filter bank AFB to the ambisonic content x(t) so as to then select, in the step S31, ambisonic component signals filtered in the range of frequencies wherein the ambisonic representation for a given order m is the most accurate (thus respecting a "validity criterion" of the ambisonic representation), and this according to the data of the microphone defined hereinabove.

According to the type of processing applied to the ambisonic content x(t), between a source separation processing SAS or a processing for a restitution on speakers RES, the step S4 aims to obtain a decoding matrix B, according to the type of processing selected. In the case of an ambisonic restitution on speakers, the decoding matrix B is the inverse of a matrix A containing coefficients proper to special positions of speakers used for the restitution.

In the case of source separation, the decoding matrix B is initially developed in the step S4 for the purpose of a blind source separation processing using filtered and selected ambisonic components. More particularly, this decoding matrix B is developed for the frequency band containing the largest number of valid ambisonic channels (and the highest order able to be obtained M).

The determining of the frequency bands of validity of the various ambisonic order can be suited to the ambisonic microphone that was used for the capturing of the ambisonic components to be decoded. To do this, it is possible for example to use as a base the frequency variations in the accuracy of the ambisonic representation for various orders m, of the type shown in FIG. 5.

More generally, an "average" rate of the frequency variations in the accuracy of the ambisonic representation can be determined for the various orders m for different ambisonic microphone models, and these average rates can be used is this data is not available, at decoding.

In the step S7, at least two matrices B1, B2 are determined, coming from the matrix reduction of the decoding matrix B for each frequency sub-band (in the example shown the frequency sub-bands f1 and f2). A more accurate embodiment of this matrix reduction will be described hereinafter in reference to FIG. 8. Then, in the step S8, the product is taken of each matrix B1 and B2 obtained in the preceding step by the ambisonic signals filtered in the corresponding sub-bands f1, f2. In each sub-band k (k=1,2), a set of extracted signals sk is thus obtained.

In the step S9, the vectors of extracted signals s1 (1 for k=1) and s2 (2 for k=2) are combined in order to obtain the full-band reconstructed signals (by application for example of a synthetic filter band).

Figure 8:
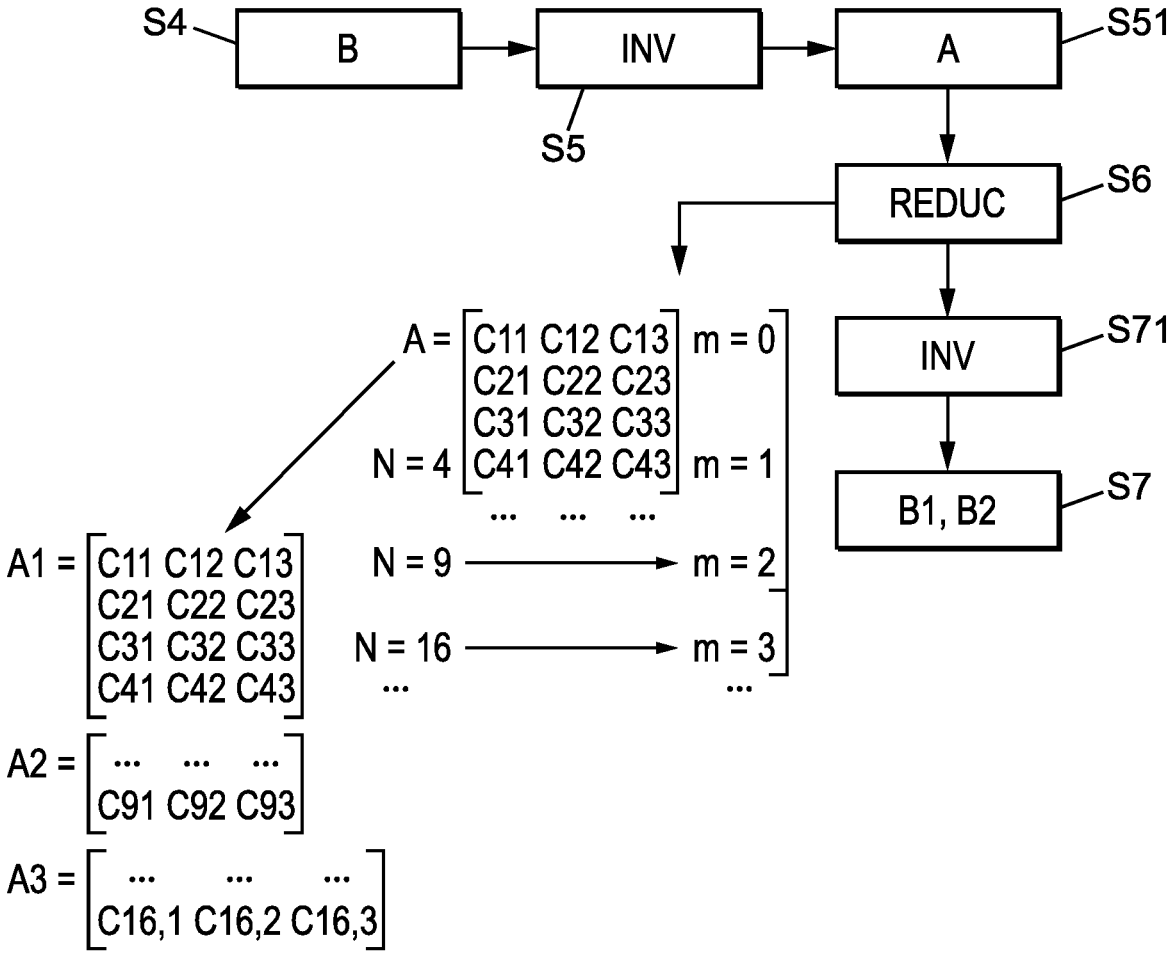
FIG. 8 shows the steps of a particular embodiment of the method according to the invention.

FIG. 8 shows the steps of a particular embodiment of the method according to the invention. More precisely, FIG. 8 shows steps of the method that can be implemented between the steps S4 and S7 of FIG. 7.

In the step S4, as described hereinabove, the decoding matrix B defined hereinabove is obtained. In the step S5 it is possible to carry out an inversion of this decoding matrix B (or equivalently, a determining of its pseudo-inverse) in order to obtain the corresponding mixing matrix A (step S51). In the case of source separation, the mixing matrix A can thus contain coefficients relative to respective positions of sound sources to be extracted. In the case of a restoration on speakers, the mixing matrix A can contain coefficients relative to the position of the speakers where on it is desired to restore the decoded signals. More precisely, the lines of the mixing matrix A correspond to the successive ambisonic channels (defining successively the orders m=0 to m=M, where M is the maximum ambisonic order available) and its columns correspond to the sources or to the speakers.

In the step S6, it is possible to reduce the dimensions of the mixing matrix A, in order to obtain sub-matrices A1, A2. This is a matrix reduction of which the number of lines corresponds to the numbers of ambisonic channels for each order. Typically, if the ambisonic signals are indeed encoded in the band from 100 to 1000 Hz, where the order m=1 is indeed respected (at least for the ambisonic microphone of FIG. 5), a sub-matrix A1 with N=4 lines associated with the order m=1 and with the frequency band 100-1000 Hz is already extracted from the matrix A. Then, if the ambisonic signals are indeed represented in the band from 1000 to 10,000 Hz, where the order m=2 is indeed respected, a matrix A2 with N=9 lines and associated with the order m=2 and with the frequency band 1000-10,000 Hz is then extracted from the matrix A and so on. The number of sub-matrices thus depends on the order of the ambisonic content x(t) of which the components are retained as valid in the step S31. Each sub-matrix then corresponds to a frequency band, and can thus contain a number of lines that correspond to the number of valid channels for this frequency band. More precisely, as shown in FIG. 8, for each sub-band, the number of corresponding valid channels is identified. For example, for a sub-band f1 selected for the order m=1 of the ambisonic content x(t), a matrix A1 comprising four lines ($N1=(m+1)^2$) corresponding to the four ambisonic channels with order 1 is extracted, and the number of "sources" (sources to be extracted or speakers) in columns. As shown in FIG. 8, the four lines retained for the construction of the sub-matrix A1 are the coefficients of the global initial matrix A:

C11, C12, C13,
C21, C22, C23,
C31, C32, C33, and
C41, C42, C43.

Regarding the sub-matrix A2, these lines of the global matrix A can be used, as well as the following, up to the line:

C91, C92, C93.

For the mixing matrix A2, corresponding to the order 2 of the ambisonic content x(t), and therefore to the sub-band f2, nine lines are therefore retained, corresponding to the nine channels of order 2, and the number of sources to be extracted in columns.

Each mixing sub-matrix thus obtained is of dimension N×Ntarget, with Ntarget the number of sources coming from the blind source separation or the number of speakers provided for a restitution.

In the case of a restitution on speakers, the number of speakers is preferably equal to or greater than the number of lines. For example, for the mixing matrix A1 of four lines, a set of four columns may only be retained. In the case of source separation, the number of columns can be less than or equal to the number of lines. For example, for the mixing matrix A1 of four lines, the columns can be suppressed and sources can be retained for example of which the signals are of greater energy and/or those which are the least correlated (sources that are the least "mixed" possible) and/or the signals that correspond to the direct field of the sources, or others.

In the step S71 an inversion of each mixing sub-matrix A1, A2 is carried out in order to respectively obtained the decoding sub-matrices B1, B2 presented hereinabove (step S7). Passing through the mixing matrix A makes it possible in particular to retain satisfactory energy levels of the ambisonic components linked to each order, despite the matrix reductions. In other terms, the steps S5 to S71 make it possible to "refine" the decoding of the ambisonic content x(t).

Figure 9:
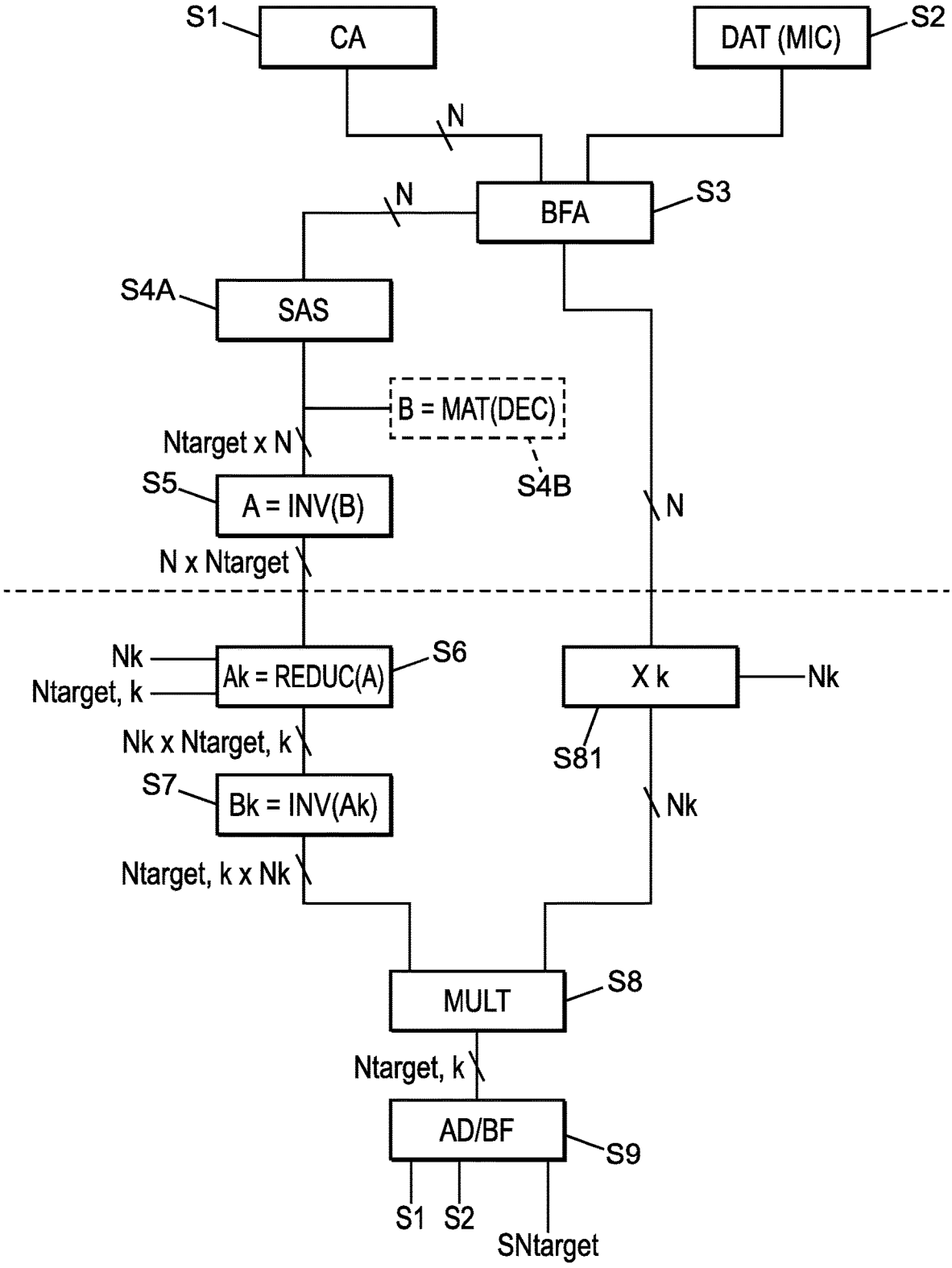
FIG. 9 is a block diagram of a processing algorithm corresponding to the embodiment shown in FIG. 7, and FIG. 10 diagrammatically shows a possible device for the implementing of the invention.

FIG. 9 is a block diagram of a processing algorithm corresponding to the embodiment shown in FIGS. 7 and 8. The same references of steps S1, S2, etc. have been included, in order to designate identical or similar steps and presented hereinabove in reference to FIGS. 7 and 8.

The word "channels" is used to refer to the ambisonic microphone sources and "sources" for the signals to be extracted (sources effectively to be extracted or the supply signals of the speakers). In the step S1, there is an ambisonic content x(t) of order M, comprising a plurality of recorded ambisonic channels N to be processed. Generally, the number of recorded ambisonic channels is equal to $N=(M+1)^2$. In the step S2, there is data relative to the ambisonic capture of the content x(t) (data relative to the ambisonic microphone MIC used, etc.).

Knowing the validity limits of the microphone encoding, a frequency band is determined for each ambisonic order. A filter bank allowing for a reconstruction is applied to the N ambisonic channels in the step S3, in order to give K sub-bands noted as xk. The sub-bands are selected to correspond to the different validity ranges of the microphone encoding.

In a particular embodiment in the step S4A shown as a solid line, a source separation matrix B developed according to the frequency filtered ambisonic components (top arrow coming onto rectangle S4A) is used. More particularly, a blind source separation method is applied in the sub-band containing the most valid channels, in order to obtain a separating matrix B of dimensions Ntarget×N, Ntarget being the number of sources obtained by the blind source separation in the selected frequency sub-band.

The valid channels are determined using a validity criterion relative to each order of the ambisonic content x(t) according to each frequency band of the filter bank. More generally, in order to maximise the quality of the source separation, a frequency band is selected that has the most ambisonic components that are valid. The term "valid" means components of which the energy criteria or directivity were not biased during the ambisonic capture, as presented hereinabove in reference to FIG. 5. The validity of each order in frequency bands of the audio domain can be established by knowing the limits of the ambisonic microphone used during the capturing of the ambisonic content x(t), or using a chart established on the basis of measurements taken over a plurality of ambisonic microphones, which makes it possible to take an average of the validity of each ambisonic order in each frequency band.

For example, the ambisonic channels of order 1 tend to be valid in a frequency band ranging from 100 HZ to about 10 kHz. The frequency band in which the ambisonic channels of order 2 can be more generally valid can for example range from 1 kHz to 9 kHz, etc.

In an alternative embodiment for the purpose of a restitution of a sound stage over several speakers (more than two in general), in the step S4B (shown as a dotted line in FIG. 9, in order to designate this alternative), the decoding matrix is constructed according to the position of the speakers on which the content is to be restored. More exactly, this decoding matrix B corresponds to the inverse of a mixing matrix A which is defined by the respective spatial positions of the speakers.

Returning to the general processing (for a restitution or for a separation of sources), in the step S5, the "theoretical" mixing matrix A (for the two aforementioned alternatives) is constructed through inversion of B. For source separation, the mixing matrix is comprised of N lines and of Ntarget columns, the ith column containing the spherical harmonic coefficients, relative to the coordinates ($\theta_i$, $\phi_i$) of the source $s_i$. Hereinbelow is an example of a mixing matrix A in the case of a separation of sources for an ambisonic content of order 2 comprised of five sources:

$$A_{9\times5}=\begin{array}{c} \begin{array}{ccccc} S_1 & S_2 & S_3 & S_4 & S_5 \end{array} \\ \left[\begin{array}{ccccc} 1 & 1 & 1 & 1 & 1 \\ Y_{11}^{1}(1) & Y_{11}^{1}(2) & Y_{11}^{1}(3) & Y_{11}^{1}(4) & Y_{11}^{1}(5) \\ \cdots & \cdots & \cdots & \cdots & \cdots \\ \cdots & \cdots & \cdots & \cdots & \cdots \\ Y_{20}^{1}(1) & \cdots & \cdots & \cdots & \cdots \\ \cdots & \cdots & \cdots & \cdots & \cdots \\ \cdots & \cdots & \cdots & \cdots & \cdots \\ \cdots & \cdots & \cdots & \cdots & \cdots \\ Y_{22}^{1}(1) & \cdots & \cdots & \cdots & Y_{22}^{1}(5) \end{array}\right] \end{array} \begin{array}{l} \text{Ordre 0} \\ \left.\begin{array}{l} \\ \\ \\ \end{array}\right\} \text{Ordre 1} \\ \left.\begin{array}{l} \\ \\ \\ \\ \end{array}\right\} \text{Ordre 2} \end{array}$$

For the diffusion on speakers, A is comprised of N lines and of a minimum of N columns, the ith column containing the spherical harmonic coefficients, relative to the coordinates ($\theta_i$, $\phi_i$) of the speaker i.

In the step S6, and for each sub-band k, a mixing sub-matrix Ak is constructed, such that Ak is a truncated version of the matrix A, retaining only the Nk lines that correspond to the channels that are effectively valid in this sub-band k.

For source separation, if Nk is less than the number of sources Ntarget sought in the sub-band, only one set of Ntarget,k, columns (with Ntarget,k less than or equal to Nk) is retained, selected according to energy criteria (for example by separating the sources that have the largest contribution) or according to other criteria of interest such as defined hereinabove. The matrix Ak thus has for dimensions Nk×Ntarget,k, with Ntarget,k=min(Nk, Ntarget) for example. Hereinbelow is an example of a truncated matrix Ak(4×4) at ambisonic order 1:

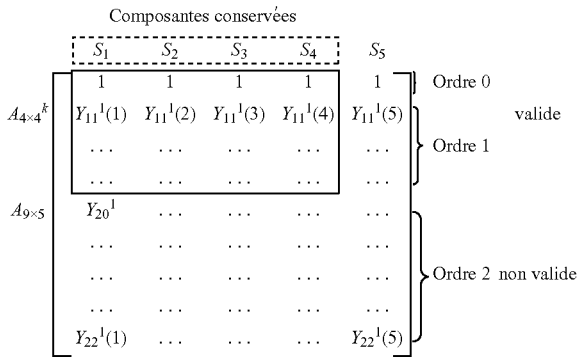

For the restitution on speakers, a set of Nk speakers is selected for the restitution, and Ak therefore has for dimensions Nk×Nk.

In the step S7, the matrix Ak is inverted in order to give Bk. When the sub-matrix Ak is not a square matrix, there are an infinite number of possibilities for the inversion. A pseudo-inversion can be applied, or an inversion by applying additional constraints (for example selection of the solution that gives the most direct beamforming, or that minimises the secondary lobes).

Generally, the term "matrix inversion" means a conventional matrix inversion as well as a pseudo-inversion as presented hereinabove.

Then, in the step S8, Bk is applied to the sub-band xk in order to obtain the signals sk such that $$sk=Bk\cdot xk$$

Once the sources have been extracted in each sub-band, the corresponding full-band signals are reconstructed by a synthetic filter using the sub-band signals of the same direction, in the step S9.

Hereinbelow, an example of an embodiment of the method according to a particular embodiment of the invention is described by way of example.

There is an ambisonic content of order 2 (9 channels) sampled at 16 kHz, noted as x(t) comprised of 3 sources that are to be extracted. The ambisonic encoding at orders 0 and 1 is valid between 200 Hz and 8000 Hz. The encoding of the order 2 is valid between 900 Hz and 8000 Hz.

A filter bank is implemented, formed from two frequency bands, 200 Hz-900 Hz (up to order 1) and 900 Hz-8000 Hz (use of order 2)

The filter bank is applied to x(t), in order to form x1(*t*) and x2(*t*). x1(*t*) is formed from 4 channels (ambisonics of order 1) and x2(*t*) contains 9 channels (ambisonics of order 2).

A separating matrix B of dimensions 3×9 is estimated via independent component analysis carried out in the sub-band 900 Hz-8000 Hz i.e. x2(*t*).

A theoretical mixing matrix A, of dimensions 9×3, is deduced by inversion of B, each column i containing the spherical harmonic coefficients of the source i.

At the same time, the matrices A1 and A2 are calculated using A in order to extract the sources in each sub-band:

- A1 contains only the coefficients up to order 1 for the three sources, i.e.: A1=A (the first four lines, the first three columns),
- A2 contains the coefficients relating to the nine channels for the three sources, there is therefore: A2=A A1 and A2 are inverted in order to form the separation matrices B1 and B2.

The three sources are extracted in each respective sub-band of indexes 1 and 2:

$$s1=B1\cdot x1 \text{ and } s2=B2\cdot x2$$

Then, the full-band sources are reconstituted by application of the synthetic filter to the signals in sub-bands s1 and s2, for example and adding, band by band (if the analysis filter band was in base band):

$$s=s1+s2$$

Figure 10:
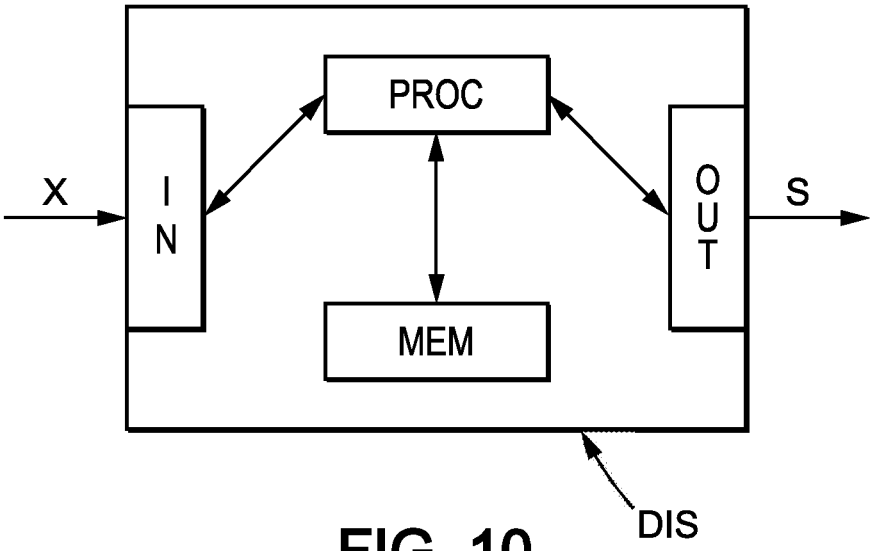

In reference to FIG. 10, this invention also relates to a device DIS for the implementing of the invention. This device DIS can include an input interface IN for receiving ambisonic signals x(t). The device DIS can include a memory MEM for storing instructions of a computer program in terms of the invention. The instructions of the computer program are instructions for processing ambisonic signals x(t). They are implemented by a processor PROC, in order to deliver, via an output interface OUT, decoded signals s(t).

Of course, this invention is not limited to the embodiments described hereinabove by way of example; it extends to all alternatives.

Typically, the frequency ranges for which the ambisonic representation is valid are given hereinabove by way of example and can differ according to the nature of the ambisonic microphone or microphones used for the capturing, even the capturing conditions themselves.

The invention claimed is:

1. A method of processing an ambisonic content, the ambisonic content comprising a plurality of ambisonic components of a plurality of orders defining a succession of ambisonic channels in each of which an ambisonic component is represented, the method comprising the following acts performed by a processing device:

- frequency filtering of the ambisonic components in a plurality of frequency bands,
- compiling an ambisonic decoding matrix,
- processing the ambisonic decoding matrix in order to extract, by matrix dimension reduction, a plurality of ambisonic decoding sub-matrices each associated with an ambisonic order and a frequency band selected for this ambisonic order,
- respective applications of the decoding sub-matrices to the ambisonic components in each selected frequency band, and a reconstruction, band by band, of the results of said respective applications, in order to deliver a plurality of decoded signals, each associated with a sound source.

2. The method according to claim 1, wherein each sub-matrix is associated with a frequency band selected according to a validity criterion of the ambisonic components of the order with which said sub-matrix is associated, in said selected frequency band.

3. The method according to claim 2, wherein the validity criterion of the components is defined by conditions for capturing said ambisonic components, by at least one ambisonic microphone.

4. The method according to claim 3, comprising:

- receiving data from at least one ambisonic microphone used to capture said ambisonic components;
- determining frequency bands selected for constructing said sub-matrices, according to said ambisonic microphone data.

5. The method according to claim 1, wherein, each ambisonic decoding sub-matrix being associated with an ambisonic order and a frequency band selected for this ambisonic order, a frequency band is selected in a range from 100 Hz to 10 kHz for the ambisonic order m=1, a frequency band is selected in a range from 500 Hz to 10 kHz for the ambisonic order m=2, a frequency band is selected in a range from 2000 Hz to 9000 Hz for the ambisonic order m=3, a frequency band is selected in a range from 3000 Hz to 7000 Hz for the ambisonic order m=4.

6. The method according to claim 1, wherein the processing of the ambisonic decoding matrix comprises:

inverting the developed ambisonic decoding matrix, in order to obtain a mixing matrix of which:

the lines correspond to respective ambisonic channels, and the columns correspond to sound sources, processing the mixing matrix in order to extract, by matrix dimension reduction, a plurality of mixing sub-matrices each associated with an ambisonic order and a selected frequency band, and inverting mixing sub-matrices in order to obtain respectively said ambisonic decoding sub-matrices.

7. The method according to claim 1, wherein the processing of the ambisonic content is conducted for a source separation and said decoding matrix is a blind source separation matrix developed from ambisonic components.

8. The method according to claim 7, wherein each sub-matrix is associated with a frequency band selected according to a validity criterion of the ambisonic components of the order with which said sub-matrix is associated, in said selected frequency band and wherein the separating matrix is developed from ambisonic components filtered at a selected frequency band and wherein the number of valid ambisonic channels according to said criterion is maximal.

9. The method according to claim 6, wherein the processing of the ambisonic content is conducted for a source separation and said decoding matrix is a blind source separation matrix developed from ambisonic components the method further comprising a simplification of the mixing sub-matrices before the inversion thereof, by reduction in the number of column of each sub-matrix, with the remaining columns of the sub-matrices being selected in such a way as to retain signals with the highest energies after application of the decoding sub-matrices.

10. The method according to claim 6, wherein the processing of the ambisonic content is conducted for a source separation and said decoding matrix is a blind source separation matrix developed from ambisonic components, the method further comprising a simplification of the mixing sub-matrices before the inversion thereof, by reduction in the number of column of each sub-matrix, with the remaining columns of the sub-matrices being selected in such a way as to retain the least correlated signals after application of the decoding sub-matrices.

11. The method according to claim 6, wherein the processing of the ambisonic content is conducted for a source separation and said decoding matrix is a blind source separation matrix developed from ambisonic components, the method further comprising a simplification of the mixing sub-matrices before the inversion thereof, by reduction in the number of column of each sub-matrix, with the remaining columns of the sub-matrices being selected in such a way as to retain the signals corresponding to direct sound fields after application of the decoding sub-matrices.

12. The method according to claim 1, wherein the processing of the ambisonic content is conducted for an ambisonic restitution on a plurality of speakers and said decoding matrix is an inverse matrix of relative spatial positions of the speakers.

13. The method according to claim 1, comprising, for an ambisonic content broken down into frequency sub-bands, an application of decoding sub-matrices, obtained by:

for each ambisonic order of the content, a determining of a frequency band on which said order respects a predetermined validity criterion of ambisonic encoding, based on said frequency bands, an application of a filter bank to the ambisonic content in order to produce a plurality of signals in sub-bands, of variable dimensions corresponding to valid ambisonic channels in this sub-band, determining of a decoding matrix of maximum size in the frequency band of the maximum ambisonic order and of an associated mixing matrix, inverse or pseudo-inverse of said decoding matrix, for each other frequency band, a determining of a mixing matrix of reduced size, sub-matrix of said mixing matrix, and of a decoding sub-matrix, inverse or pseudo-inverse of said mixing sub-matrix, reconstructing of full-band separated signals by application of a synthetic filter bank to the separated signals coming from the multiplication of said signals by said matrices.

14. A non-transitory computer readable medium storing instructions of a computer program for implementing a method of processing an ambisonic content, when such instructions are run by a processor of a device, the ambisonic content comprising a plurality of ambisonic components of a plurality of orders defining a succession of ambisonic channels in each of which an ambisonic component is represented, and wherein the instructions configure the device to:

frequency filter of the ambisonic components in a plurality of frequency bands, compile an ambisonic decoding matrix, process the ambisonic decoding matrix in order to extract, by matrix dimension reduction, a plurality of ambisonic decoding sub-matrices each associated with an ambisonic order and a frequency band selected for this ambisonic order, respectively apply the decoding sub-matrices to the ambisonic components in each selected frequency band, and reconstruct, band by band, the results of said respective applications, in order to deliver a plurality of decoded signals, each associated with a sound source.

15. A device comprising:

an input interface for receiving ambisonic component signals, an output interface for delivering decoded signals, each associated with a sound source, and a processing circuit configured to process an ambisonic content, the ambisonic content comprising a plurality of ambisonic components of a plurality of orders defining a succession of ambisonic channels in each of which an ambisonic component is represented, the processing comprising:

frequency filtering of the ambisonic components in a plurality of frequency bands, compiling an ambisonic decoding matrix, processing the ambisonic decoding matrix in order to extract, by matrix dimension reduction, a plurality of ambisonic decoding sub-matrices each associated with an ambisonic order and a frequency band selected for this ambisonic order, respective applications of the decoding sub-matrices to the ambisonic components in each selected frequency band, and a reconstruction, band by band, of the results of said respective applications, in order to deliver a plurality of decoded signals, each associated with a sound source.

* * * * *